US007029425B2

(12) United States Patent
Krull

(10) Patent No.: US 7,029,425 B2
(45) Date of Patent: Apr. 18, 2006

(54) METHODS AND APPARATUS FOR SUPPORTING EXERCISE DUMBBELLS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 82 days.

(21) Appl. No.: 10/428,179

(22) Filed: Apr. 30, 2003

(65) Prior Publication Data

US 2004/0220024 A1 Nov. 4, 2004

(51) Int. Cl.
*A63B 21/00* (2006.01)

(52) U.S. Cl. ..... 482/94; 482/92; 482/106

(58) Field of Classification Search ..... 482/57, 482/92, 94, 93, 104–108, 148, 910
See application file for complete search history.

(56) References Cited

U.S. PATENT DOCUMENTS 5,630,776 A * 5/1997 Yang ..... 482/104
6,447,428 B1 * 9/2002 McKillip ..... 482/57

* cited by examiner

*Primary Examiner*—Glenn E. Richman

(57) ABSTRACT

A dumbbell stand includes first and second dumbbell supports that pivot about a common pivot axis between a first, relatively compact configuration and a second, spread apart configuration.

13 Claims, 3 Drawing Sheets

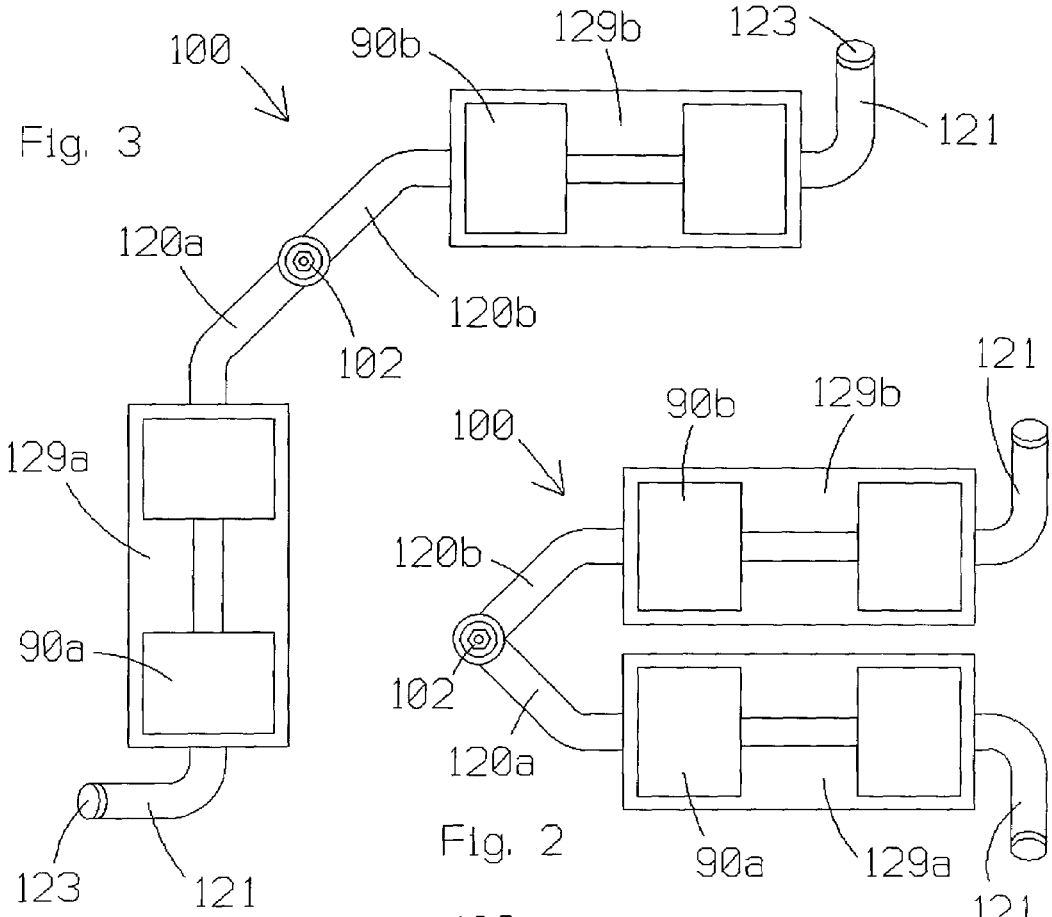
Fig. 3
Fig. 2
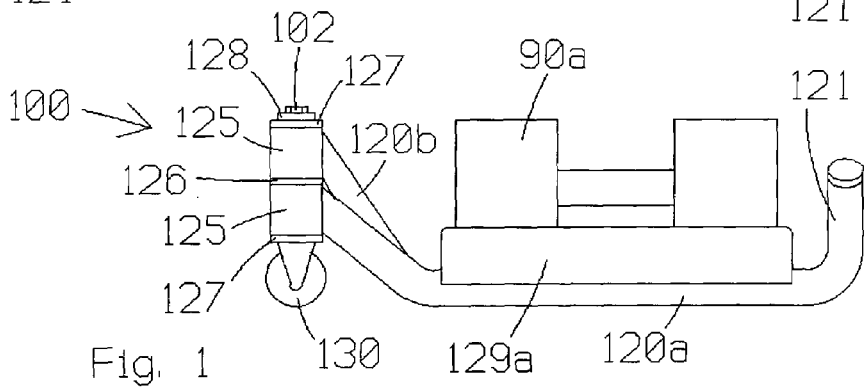
Fig. 1

METHODS AND APPARATUS FOR SUPPORTING EXERCISE DUMBBELLS

FIELD OF THE INVENTION

The subject invention relates to exercise methods and apparatus, and more specifically, to dumbbell stands (alone and in combination with dumbbells to provide exercise systems).

BACKGROUND OF THE INVENTION

Various types of exercise equipment are known in the art. One popular form of strength equipment is the exercise dumbbell, which is typically designed with one or more weights disposed at each end of a handle. Relatively more advanced dumbbell systems provide a plurality of weights in alignment with the handle for selective connection to the handle. Examples of such systems are disclosed in U.S. Pat. No. 4,822,034 to Shields; U.S. Pat. No. 4,284,463 to Shields; U.S. Pat. No. 5,637,064 to Olson et al.; U.S. Pat. No. 5,769,762 to Towley, III et al.; U.S. Pat. No. 5,839,997 to Roth et al.; and U.S. Pat. No. 6,402,666 to Krull. An object of the present invention is to provide methods and apparatus for supporting exercise dumbbells in user friendly fashion, and/or supporting selectorized dumbbell weights that remain behind when the handles are lifted.

SUMMARY OF THE INVENTION

The present invention provides methods and apparatus for supporting dumbbells. For example, the present invention may be described in terms of a stand having first and second dumbbell supports configured to support respective first and second dumbbells. The dumbbell supports are movably interconnected for pivoting about a common pivot axis to adjust a distance defined between the dumbbells. The dumbbell supports may also be configured and arranged for movement across an underlying floor surface. Among other things, floor engaging rollers may be provided on the dumbbell supports and/or other portions of the stand to facilitate rolling across an underlying floor surface. Accessory items, including a flip chart and/or a storage tray may be mounted on the one or more of the dumbbell supports and/or other portions of the stand, as well.

In a preferred application, the subject invention is configured to support first and second selectorized dumbbell assemblies, each of which includes (a) a handle member; (b) a set of weights configured for connection to a respective said handle member; and (c) a base that is sized and configured to support a respective set of weights in alignment with a respective handle member. Each such base is mounted on a respective dumbbell support. Various features and/or advantages of the present invention may become apparent from the more detailed description that follows.

BRIEF DESCRIPTION OF THE DRAWING

With reference to the Figures of the Drawing, wherein like numerals represent like parts and assemblies throughout the several views, FIG. 1 is a side view of a first exercise system constructed according to the principles of the present invention, and arranged in a first configuration;

FIG. 2 is a top view of the exercise system of FIG. 1 in the same first configuration;

FIG. 3 is a top view of the exercise system of FIG. 1 arranged in a second configuration;

DETAILED DESCRIPTION OF THE PREFERRED EMBODIMENT

Figure 4:
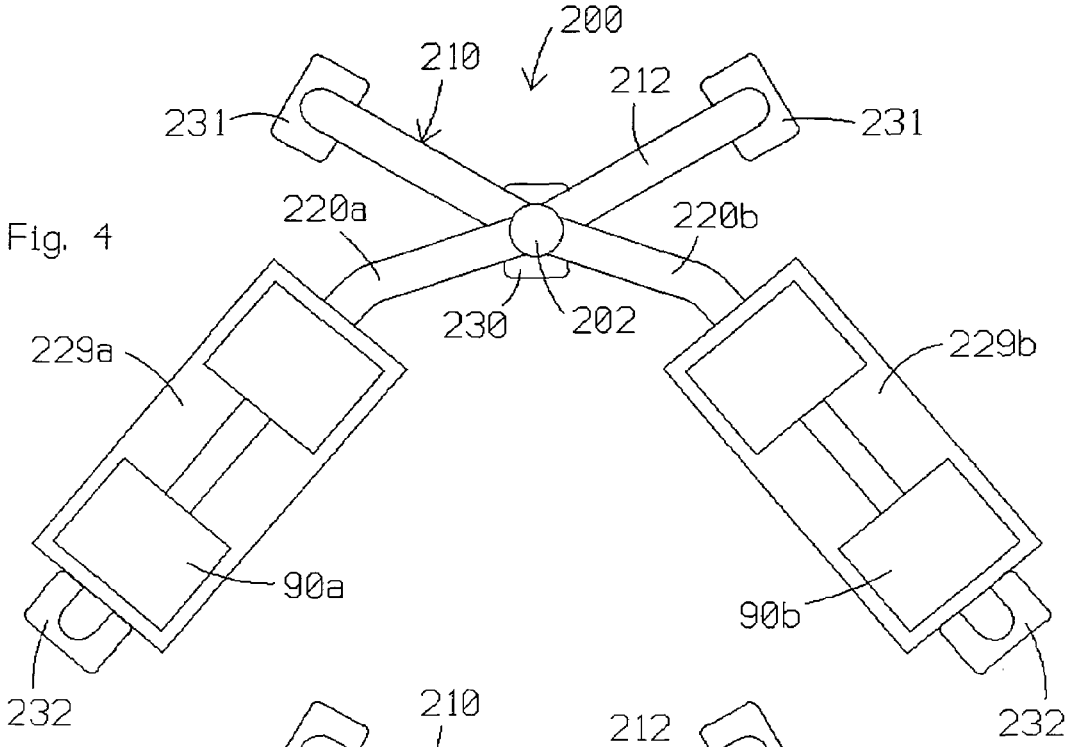
FIG. 4 is a top view of a second exercise system constructed according to the principles of the present invention, and arranged in a first configuration.

A first exercise system constructed according to the principles of the present invention is designated as 100 in FIGS. 1–3. The system 100 may be described in terms of a pair of known selectorized dumbbells 90*a* and 90*b* disposed on a novel, low-profile stand having a height of six to eight inches.

The dumbbells 90*a* and 90*b* are shown somewhat diagrammatically because their construction and operation are already known in the art. For purposes of this disclosure, the dumbbells 90*a* and 90*b* may be any of various embodiments disclosed in U.S. Pat. No. 6,402,666 to Krull (which is incorporated herein by reference), recognizing that the present invention is not limited to these particular dumbbells or types of dumbbell. Some other examples of appropriate dumbbells are disclosed in the other patents discussed in the Background of the Invention, which patents are also incorporated herein by reference.

Generally speaking, each dumbbell 90*a* and 90*b* includes a handle member and a plurality of weight plates that are selectively connected to a respective handle member. A weight base or cradle 129*a* and 129*b* is provided for each dumbbell 90*a* and 90*b* to support the weight plates in proper alignment when not in use. The cradles 129*a* and 129*b* are mounted on respective first and second dumbbell supports 120*a* and 120*b* by bolts (not shown) or other suitable means. Pads and/or washers with counter-sunk depressions (not shown) may be mounted on the supports 120*a* and 120*b* and/or the heads of the bolts, respectively, to provide a desirable floor engaging interface for the system 100. Also, the bottom of each cradle 129*a* and 129*b* is preferably configured to register with a respective dumbbell support 120*a* or 120*b*.

Each dumbbell support 120*a* and 120*b* may be described as a bent steel tube having a first distal end 121 that is configured and arranged to function as a handle, and an opposite, second end 122 that is connected to a respective sleeve 125. A plug 123 is preferably inserted into each first end 121 to "finish" the end of the tube. The sleeves 125 may be described as tube segments that are preferably welded to the second ends 122 of respective supports 120*a* and 120*b*.

As best seen in FIG. 1, the two supports 120*a* and 120*b* are configured somewhat differently relative to one another in order to position the sleeves 125 in vertical alignment as shown. Each sleeve 125 is sandwiched between the intermediate bushing 126 and a respective end bushing 127, and rotatably mounted on an intermediate frame member (hidden from view). Each end bushing 127 is preferably provided with a tubular portion (hidden from view) that is configured and arranged to extend between the frame member and a respective sleeve 125. The frame member may be described as a steel tube that extends between the visible rims of the end bushings 127.

A caster or roller assembly 130 is disposed beneath the lower end bushing 127. The assembly 130 includes a roller, a roller support or trunnion, and a bolt (hidden from view) that is rigidly connected to the trunnion and extends upward through the frame member. A washer 128 is disposed on the bolt immediately above the upper end bushing 127, and a nut 102 is threaded onto the distal end of the bolt to hold the components together. The resulting arrangement establishes a pivotal interconnection between the supports 120*a* and 120*b*, and may be described as a stand having first and second dumbbell supports 120*a* and 120*b* that pivot relative to a frame member and one another. Among other things, those skilled in the art will recognize that an alternative embodiment may be constructed with one of the supports pivotally connected directly to the other support (without an intermediate frame member interconnected therebetween).

FIGS. 2 and 3 show how the supports 120*a* and 120*b* on the system 100 may be pivoted between a compact configuration and a spread configuration. The compact configuration (shown in FIG. 2) has a relatively small "footprint" and facilitates movement of the system 100 to and from a storage position, such as beneath a bed. The spread configuration (shown in FIG. 3) has a larger "footprint" and provides a significantly larger gap between the dumbbell supports 120*a* and 120*b* to accommodate a person's feet or knees for purposes of accessing the dumbbells 90*a* and 90*b* without leaning forward.

Figure 5:
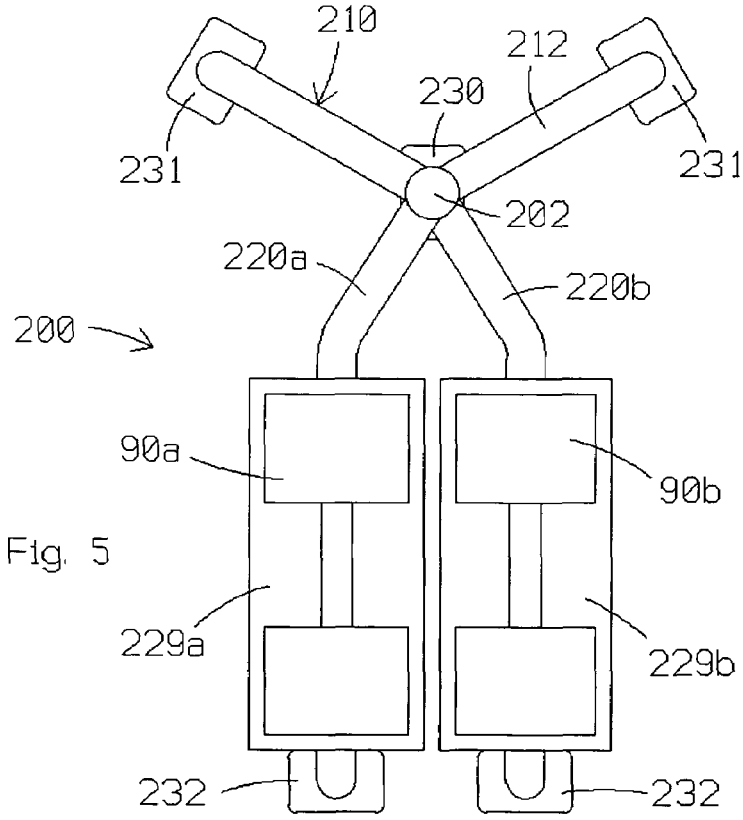
FIG. 5 is a top view of the exercise system of FIG. 4 arranged in a second configuration.

A second exercise system constructed according to the principles of the present invention is designated as 200 in FIGS. 4–5. The system 200 may similarly be described in terms of a pair of known selectorized dumbbells 90*a* and 90*b* disposed on a novel stand (that is relatively taller than the previous stand).

A weight base or cradle 229*a* or 229*b* is provided for each dumbbell 90*a* and 90*b* to support the associated weight plates in proper alignment when not in use. The cradles 229*a* and 229*b* are mounted on respective first and second dumbbell supports 220*a* and 220*b* by bolts (not shown) or other suitable means. The bottom of each cradle 229*a* and 229*b* is preferably configured to register with a respective dumbbell support 220*a* or 220*b*.

Each dumbbell support 220*a* and 220*b* may be described as a generally L-shaped member having a leg or vertical portion that is supported by an underlying floor surface, and a beam or horizontal portion that supports a respective dumbbell 90*a* or 90*b*, and that is rotatably connected to an intermediate frame member 210. Each vertical portion terminates in a lower distal end, to which a respective caster or roller assembly 232 is preferably mounted. Each horizontal portion terminates in a distal end that is rigidly connected to a respective sleeve (by welding or other suitable means).

The intermediate frame member 210 may be described in terms of a generally V-shaped member 212 having first and second legs that extend away from a common juncture and then downward toward the floor, and a post that extends upward from the juncture to support the sleeves. Caster or roller assemblies 231 are mounted on the lower distal ends of the member 212, and another caster or roller assembly 230 is mounted on the V-shaped member 212 beneath the common juncture (and the post). Each sleeve is rotatably mounted on the post for rotation about a common vertical axis. In order to accommodate both sleeves in vertical alignment on a single post, the distal horizontal ends of respective dumbbell supports 320*a* and 320*b* are angled in opposite upward and downward directions to arrive at different elevations along the post.

A lower collar, an intermediate collar, and an upper collar are secured to the post (by set screws or other suitable means) at positions above and below respective sleeves to prevent translational movement of the sleeves, and to function as bushings between the post and the sleeves. An end cap 202 is mounted on top of the post, but an accessory tray could be provided in its place (as further discussed below).

As suggested by FIGS. 4 and 5, the supports 220*a* and 220*b* cooperate with the frame member 210 to define a stand that may be rearranged or transformed between multiple configurations. FIG. 5 shows a relatively compact configuration, wherein load bearing portions of the dumbbell supports 220*a* and 220*b* extend parallel to one another, and the dumbbells 90*a* and 90*b* are adjacent one another (with a distance of about six inches defined between their handles). FIG. 4 shows a spread configuration, wherein the load bearing portions of the dumbbell supports 220*a* and 220*b* cooperate to define a V-shaped arrangement, and a person may stand between the dumbbells 90*a* and 90*b* (because a relatively greater distance of about twenty inches is now defined between their handles).

A third exercise system constructed according to the principles of the present invention is designated as 300 in FIGS. 6–9. The system 300 may similarly be described in terms of a pair of known selectorized dumbbells 90*a* and 90*b* disposed on a novel stand that is similar in height to the stand of the second system 200.

A weight base or cradle 329*a* or 329*b* is provided for each dumbbell 90*a* and 90*b* to support the weight plates in proper alignment when not in use. The cradles 329*a* and 329*b* are mounted on respective first and second dumbbell supports 320*a* and 320*b* by bolts (not shown) or other suitable means. The bottom of each cradle 329*a* and 329*b* is preferably configured to register with a respective dumbbell support 320*a* or 320*b*.

The first dumbbell support 320*a* may be described as an inverted, generally U-shaped member having first and second vertical portions or legs, and a generally horizontal portion or beam that extends therebetween and supports the first dumbbell 90*a*. A caster or roller assembly 330 is mounted to a lower distal end of the first vertical portion, and a base or foot 303 is rigidly mounted on a lower distal end of the second vertical portion. The foot 303 preferably includes a steel plate that is welded to the support 320*a*, and a rubber pad that is secured beneath the plate. The second dumbbell support 320*b* may be described as a generally L-shaped leg having a vertical portion that terminates in a lower distal end, to which a caster or roller assembly 330 is mounted, and a horizontal portion that supports the second dumbbell 90*b*.

The horizontal portion of the second dumbbell support 320*b* terminates in a distal end that is rigidly connected to a sleeve 325, which in turn, is rotatably mounted on the vertical, foot supported portion of the other dumbbell support 320*a*. Lower and upper collars 327 are disposed at opposite ends of the sleeve 325, and are secured to the dumbbell support 320*a* (by set screws or other suitable means) to prevent translational movement of the sleeve 325, and to function as bushings between the support 320*a* and the sleeve 325. In order to maintain the cradles 329*a* and 329*b* at a common elevation above the floor, the distal horizontal end portion of the second dumbbell support 320*b* is angled downward toward a vertically extending portion of the support 320*a*. At the opposite, front end of the stand, the vertical, caster supported portions of the supports 320*a* and 320*b* are preferably bent as shown to enhance the stability of the stand and provide foot room for a person to stand just in front of the weight bases 329*a* and 329*b*.

Figure 6:
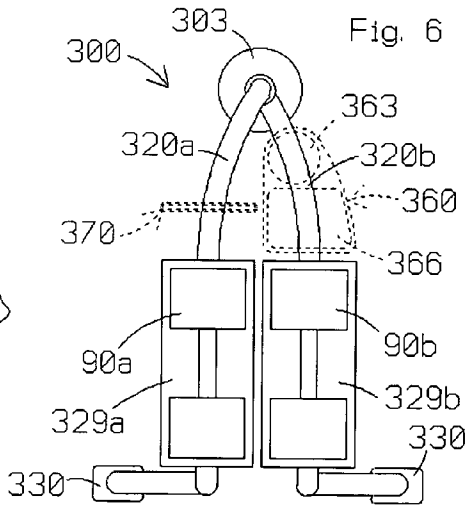
FIG. 6 is a top view of a third exercise system constructed according to the principles of the present invention, and arranged in a first configuration.
Figure 9:
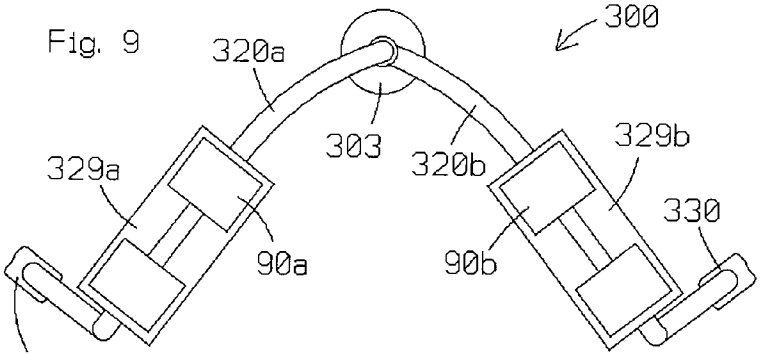
FIG. 9 is a top view of the exercise system of FIG. 6 arranged in a second configuration.

As suggested by FIGS. 6 and 9, the stand may be rearranged or transformed between multiple configurations. FIG. 6 shows a relatively compact configuration, wherein load bearing portions of the dumbbell supports 320*a* and 320*b* extend parallel to one another, and the dumbbells 90*a* and 90*b* are adjacent one another (with a distance of about six inches defined between their handles). FIG. 9 shows a spread configuration, wherein the load bearing portions of the dumbbell supports 320*a* and 320*b* cooperate to define a generally V-shaped arrangement, and a person may stand between the dumbbells 90*a* and 90*b* (because a relatively greater distance of about twenty inches is now defined between their handles).

On any of the foregoing embodiments, means may be provided for biasing the dumbbell supports toward one or more desired positions, locking the supports in desired positions, and/or preventing rotation of the supports beyond a certain position. For example, a collar may be secured to one of the supports, and a leaf spring may be secured to the other support to snap into and out of circumferentially spaced notches provided in the collar. Alternatively, snap buttons or detent pins may be configured and arranged to insert through holes in overlapping portions of the supports, or through holes in overlapping portions of the supports and an intermediate frame member. Moreover, collars or brackets may be secured to respective supports or to a support and an intermediate frame member to pivot through a desired angle before blocking one another.

Figure 7:
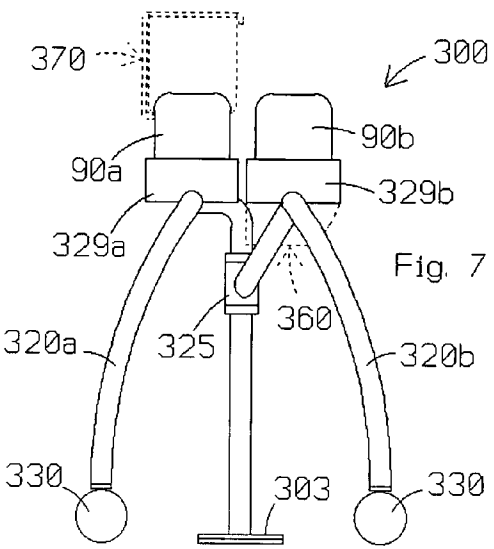
FIG. 7 is a front view of the exercise system of FIG. 6 in the same first configuration.
Figure 8:
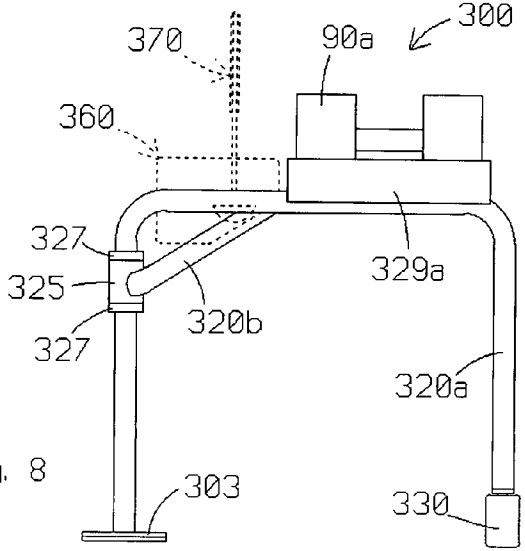
FIG. 8 is a side view of the exercise system of FIG. 6 in the same first configuration.

Various accessories may also be provided on the various embodiments of the present invention. For example, if desired, an accessory tray may be provided to hold a water bottle, personal items, etc. In this regard, FIGS. 6–8 show an optional accessory tray 360 (in dashed lines) mounted on top of the dumbbell support 320*b*. The tray 360 includes a relatively deep circular compartment 363 for a water bottle, and a relatively shallow rectangular compartment for personal items. The configuration of the tray 360 takes advantage of the downward bend in the support 320*b*. FIGS. 6–8 also show an optional flip chart assembly 370 rotatably mounted on the other support 320*a*. The flip chart assembly 370 includes a wire form, generally ?-shaped frame that extends upward from the support 320*a*. The flip chart is bound on type by circular or spiral rings that fit onto the top of the wire form frame.

The foregoing embodiments use sleeves to facilitate pivoting of the dumbbell supports, but other arrangements may be used in the alternative. For example, a bolt may be inserted through vertically aligned holes in overlapping portions of the supports, in which case, a flat interface may be provided between the supports by using flat tubes and/or suitable configured washers or other bearing members on the tubes. Also, the support tubes may be configured in different ways to achieve different results. For example, C-shaped supports may be used in such a manner that the lower distal ends are pivotally interconnected, and the upper distal ends are cantilevered, in which case the height of the dumbbell supports may be adjusted by selectively telescoping the vertical portions of the supports.

The foregoing description and accompanying drawings are directed toward specific embodiments with the understanding that various features may be mixed, matched, altered, and/or eliminated without departing from the scope of the present invention. In construing the nature and scope of the present invention, no special significance should automatically be attributed to the fact that some of the features and/or advantages are discussed and/or shown in greater detail than others, or included on some embodiments but not others. Among other things, multiple embodiments have been shown and described to emphasize that the present invention may be implemented in various ways. Recognizing that this disclosure will enable persons skilled in the art to derive additional embodiments of the present invention, the scope of the present invention should be limited only to the extent of the following claims.

What is claimed is:

1. A dumbbell stand of the type that supports a pair of exercise dumbbells, comprising:

a first dumbbell support configured to support a first dumbbell;

a second dumbbell support configured to support a second dumbbell; and a means for interconnecting the first dumbbell support and the second dumbbell support in a manner that defines a common pivot axis therebetween, and limits relative changes of orientation between the first dumbbell support and the second dumbbell support to movement about the common pivot axis.

2. The dumbbell stand of claim 1, wherein at least one roller is rotatably mounted on a lower end of the first dumbbell support, and at least one roller is rotatably mounted on a lower end of the second dumbbell support.

3. The dumbbell stand of claim 1, wherein opposing portions on the first dumbbell support and the second dumbbell are pivotal between a first configuration, extending parallel to one another and an underlying floor surface, and a second configuration, defining a V-shaped arrangement and extending parallel to the floor surface.

4. The dumbbell stand of claim 1, further comprising an accessory tray that is mounted on at least one of the first dumbbell support and the second dumbbell support.

5. The dumbbell stand of claim 1, wherein the common pivot axis extends perpendicular to an underlying floor surface at all times when the stand occupies an upright position relative to the floor surface.

6. The dumbbell stand of claim 1, wherein each said dumbbell support includes a respective weight cradle having a plurality of individual, upwardly opening weight compartments disposed at a common height above an underlying floor surface.

7. The dumbbell stand of claim 1, wherein the stand is supported on rollers configured and arranged to engage an underlying floor surface at all times when the stand occupies an upright position relative to the floor surface.

8. The dumbbell stand of claim 1, wherein the means includes at least one intermediate frame member interconnected between the first dumbbell support and the second dumbbell support, and each said dumbbell support is pivotally connected to the at least one intermediate frame member for pivoting about the common pivot axis.

9. The dumbbell stand of claim 1, wherein the first dumbbell support is pivotally connected directly to the second dumbbell support.

10. The dumbbell stand of claim 1, wherein a respective handle is mounted on each said dumbbell support and constrained to pivot together therewith relative to an opposite said dumbbell support.

11. The dumbbell stand of claim 1, wherein the second dumbbell support is a generally U-shaped member having opposite first and second ends configured to engage an underlying floor surface, and the first dumbbell support is a generally L-shaped member having a first end configured to engage the floor surface, and an opposite, second end pivotally connected to the second dumbbell support.

12. A dumbbell stand of the type that supports a pair of exercise dumbbells, comprising:

a leg configured to engage an underlying floor surface; a first dumbbell support configured to separately engage the floor surface and to support a first dumbbell above the floor surface, wherein the first dumbbell support is rigidly connected to the leg; and a second dumbbell support configured to separately engage the floor surface and to support a second dumbbell above the floor surface, wherein the second dumbbell support is pivotally connected to the leg.

13. The dumbbell stand of claim 12, wherein each said dumbbell support is a generally L-shaped member having a first end configured to engage the floor surface, and an opposite, second end connected to the leg.

* * * * *